US010352514B2

(12) United States Patent
Lian

(10) Patent No.: US 10,352,514 B2
(45) Date of Patent: Jul. 16, 2019

(54) CANDLE LAMP

(71) Applicant: Zhejiang Neeo Home Decoration Co., Ltd, Zhejiang (CN)

(72) Inventor: Zhongming Lian, Zhejiang (CN)

(73) Assignee: Zhejiang Neeo Home Decoration Co., Ltd, Zhejiang (CN)

( * ) Notice: Subject to any disclaimer, the term of this patent is extended or adjusted under 35 U.S.C. 154(b) by 34 days.

(21) Appl. No.: 15/808,909

(22) Filed: Nov. 10, 2017

(65) Prior Publication Data

US 2018/0283631 A1 Oct. 4, 2018

(30) Foreign Application Priority Data

Mar. 31, 2017 (CN) ..... 2017 2 0327728 U

(51) Int. Cl.

| | |
|---|---|
| ***F21S 10/00*** | (2006.01) |
| ***F21V 23/04*** | (2006.01) |
| ***H05B 37/02*** | (2006.01) |
| ***H05B 33/08*** | (2006.01) |
| ***F21S 10/04*** | (2006.01) |
| ***F21V 23/02*** | (2006.01) |
| ***F21S 6/00*** | (2006.01) |
| *F21Y 115/10* | (2016.01) |
| *F21W 121/00* | (2006.01) |
| *F21Y 103/33* | (2016.01) |

(52) U.S. Cl.

CPC ..... *F21S 10/002* (2013.01); *F21S 6/001* (2013.01); *F21S 10/04* (2013.01); *F21V 23/02* (2013.01); *F21V 23/04* (2013.01); *H05B 33/0857* (2013.01); *H05B 37/0272* (2013.01); *F21W 2121/00* (2013.01); *F21Y 2103/33* (2016.08); *F21Y 2115/10* (2016.08)

(58) Field of Classification Search

CPC ..... F21S 10/002; F21S 10/04; F21S 6/001; F21W 2121/00

See application file for complete search history.

(56) References Cited

U.S. PATENT DOCUMENTS

| | | | | |
|---|---|---|---|---|
| 6,439,471 | B2 * | 8/2002 | Ehrlich | F21V 35/00 239/17 |
| 9,080,762 | B2 * | 7/2015 | Ray | F21V 33/00 |
| 9,636,697 | B1 * | 5/2017 | Jih | B05B 17/08 |
| 9,890,915 | B2 * | 2/2018 | Lai | F21S 10/002 |
| 2001/0036609 | A1 * | 11/2001 | Ehrlich | F21V 35/00 431/253 |

(Continued)

*Primary Examiner* — Donald L Raleigh
(74) *Attorney, Agent, or Firm* — JCIPRNET

(57) ABSTRACT

The invention discloses a candle lamp which comprises a hollow tubular lamp body, a water storage tank arranged in the lamp body, and an isolation plate arranged in the water storage tank, wherein the isolation plate is arranged thereon with a water spray pipe and the first illuminating lamps distributed around the water spray pipe; a water pump communicated with the water spray pipe is arranged in the water chamber; and the lamp body is subtransparent. When the water pump draws water out from the water chamber, the water is sprayed out from the water spray pipe to form a fountain, and the light of the first illuminating lamps illuminates the water column to achieve visual effect being similar to the glimmering flame, which imitate the burning candles and improve the visual art of the candle lamp.

18 Claims, 11 Drawing Sheets

(56) References Cited

U.S. PATENT DOCUMENTS

| | | | | |
|---|---|---|---|---|
| 2005/0036300 | A1* | 2/2005 | Dowling | A01M 1/04 362/101 |
| 2013/0126633 | A1* | 5/2013 | Powell | B05B 17/00 239/18 |
| 2016/0363280 | A1* | 12/2016 | Angelotti | F21S 10/04 |
| 2017/0326574 | A1* | 11/2017 | Ding | B05B 17/08 |

* cited by examiner

CANDLE LAMP

CROSS-REFERENCE TO RELATED APPLICATION

This application claims the priority benefit of China application serial no. 201720327728.4, filed on Mar. 31, 2017. The entirety of the above-mentioned patent application is hereby incorporated by reference herein and made a part of this specification.

TECHNICAL FIELD

The invention relates to the field of lamps, specifically to a candle lamp.

BACKGROUND ART

The candle lamp, shaped similarly to a real candle, is also referred to as a smokeless candle lamp and comprises a candle-shaped lamp body, a power supply and a bulb arranged on the lamp body, wherein the power supply supplies power to enable the bulb to emit light, and the light emitted by the bulb shoot out, playing lighting effect. With no smog or carcinogen being generated in the illumination process, it is safe for use.

In some specific occasions, people still need to use traditional lamps such as candles, and oil lamps which realize subjective enjoyment of people through the flame visual effect when they are burning. But for forming a stable light source in the illumination process, the candle lamp does not has a unique visual effect from the glimmering flame of the burning when burning, For being single in functions, the candle lamp can neither imitate burning of the candles nor meet the living requirements of people.

SUMMARY OF THE INVENTION

The invention aims to provide a candle lamp, which provides a visual effect similar to the glimmering flame and the imitative burning effect of a candle.

The technical purpose of this invention is realized through the following technical solution. The candle lamp comprises a hollow tubular lamp body, a water storage tank arranged in the lamp body, and an isolation plate arranged in the water storage tank, wherein the water storage tank is divided into a water chamber located at the lower part and a groove located at the upper part by the isolation plate; the isolation plate is arranged thereon with a water spray pipe for communicating the water chamber with the groove, the first illuminating lamps distributed around the water spray pipe, and a backwater hole extending through the isolation plate for communicating the groove with the water chamber; a water pump is arranged in the water chamber, and a water outlet of the water pump is communicated with the water spray pipe, and a water inlet of the water pump is formed in the water chamber; and, the lamp body is subtransparent.

Through the technical solution, when the candle lamp is used, after water is injected into the water chamber, the water pump operates, then the water in the water chamber enters the water inlet of the water pump and is drained into the water spray pipe from the water outlet of the water pump, and then is sprayed out from the upper end of the water spray pipe. After being sprayed out from the water spray pipe, the water falls down under the action of gravity, then is collected in the groove above the water chamber, and then flows back to the water chamber from the backwater hole in the isolation plate. After the first illuminating lamps on the isolation plate are powered on, the light emitted by the first illuminating lamps illuminates the water column sprayed by the water spray pipe so as to achieve visual effect being similar to the glimmering flame, which imitate the burning candles. Besides, the water column sprayed from the water spray pipe forms the fountain, so that the visual art of the candle lamp is improved.

The invention is further arranged to be that the water spray pipe is arranged with a spray booth located above the first illuminating lamps.

With the technical solution adopted, the spray booth is located above the first illuminating lamps, the light emitted by the first illuminating lamps is weakened after passing through the spray booth, so that the light of the candle lamp in the illumination process is soft.

The invention is further arranged to be that a connecting hole is formed in the lower end surface of the spray booth, and the water spray pipe is in inserting connection to the interior of the connecting hole, and a water spray hole communicated with the water spray pipe is formed in the upper end surface of the spray booth.

With the technical solution adopted, because the water spray pipe is in inserting connection to the interior of the connecting hole in the lower end surface of the spray booth, and the water spray hole is communicated with the water spray pipe, when the water spray pipe sprays water upwards, the water is upwards sprayed out from the water spray hole, then the water sprayed out from the water spray pipe forms a water layer on the upper end surface of the spray booth after falling down, and then the water sprayed from the water spray pipe is upwards sprayed out after entering the water spraying layer to form a water column, and the formed water column is uniformly dispersed in the falling-down process.

The invention is further arranged to be that the spray booth comprises a transparent hollow housing and a paraffine layer filled in the housing, wherein an air vent communicated with the interior of the housing is formed in the lower end surface of the housing.

With the technical solution adopted, the spray booth comprises the housing and the paraffine layer and is entirely subtransparent.

The invention is further arranged to be that the spray booth comprises the hollow transparent housing, a chamber is arranged in the housing, a mounting hole allowing the upper end of the water spray pipe to be inserted is formed in the lower end surface of the housing, a water-penetrable hole communicating the water spray pipe with the chamber is formed in the mounting hole; and, a plurality of spray pipes communicated with the chamber and used for spraying water to a position above the center of the spray booth are arranged on the upper end surface of the spray booth.

With the technical solution adopted, when the water pump operates, the water in the water chamber enters the water spray pipe after passing through the water pump, then is sprayed out from a pipe opening in the upper end of the water spray pipe, then enters the chamber of the housing through the water-penetrable hole, and then is sprayed out from the spray pipes at the upper end of the housing; the water column sprayed from the spray pips are collected to the position above the center of the spray booth and then falls down, and the light emitted by the first illuminating lamps under the spray booth illuminates the water column to form the visual effect similar with the rolling blaze, which imitate the burning process of the flame at the same time, improve the visual art of the candle lamp.

The invention is further arranged to be that the spray booth is in the shape of the disk, and the spray pipes are uniformly distributed in the circumferential direction of the spray booth.

With the technical solution adopted, the spray booth is in the shape of the disk, and the spray pipes are uniformly distributed in the circumferential direction of the spray booth. The invention is further arranged to be that a plurality of the first illuminating lamps are uniformly distributed in the circumferential direction of the water spray pipe, and the number of the first illuminating lamps is 2 or 4.

With the technical solution adopted, the first illuminating lamps are uniformly distributed in the circumferential direction of the water spray pipe, and the number of the first illuminating lamps is 2 or 4.

The invention is further arranged to be that the decoration layer is arranged on the upper end surface of the isolation plate, and is made of paraffine.

With the technical solution adopted, because the decoration layer is arranged at the upper end of the isolation plate and is made of paraffine, which achieves the effect of decoration and makes the candle lamp being similar with a real candle.

The invention is further arranged to be that a plurality of suction cups are arranged on the water pump, and are drew to the inner wall of the water chamber.

With the technical solution adopted, the suction cups are arranged on the water pump, and are drew to the inner wall of the water chamber, so that the water pump is fixed to the interior of the water chamber.

The invention is further arranged to be that the material of water storage tank is transparent, and a step is arranged on the inner wall of the lamp body, and the water storage tank is arranged on the step.

With the technical solution adopted, the water storage tank is made of the transparent material, so that the condition that the light emitted by the first illuminating lamps are blocked is avoided. The light emitted by the first illuminating lamps becomes soft after sequentially penetrating the water storage tank and the lamp body.

The invention is further arranged to be that one circle of flange is arranged at the upper end of the water storage tank, and the lower end surface of the flange is propped against the upper end surface of the lamp body.

With the technical solution adopted, one circle of flange is arranged at the upper end of the water storage tank, and the lower end surface of the flange is propped against the upper end surface of the lamp body.

The invention is further arranged to be that material of the lamp body is made of paraffine.

With the technical solution adopted, the lamp body is made of paraffine and is similar to a real candle.

The invention is further arranged to be that a power socket is arranged in the lower end of the lamp body, a power supply is mounted in the power socket, and first illuminating lamps and the water pump are electrically connected to the interior of the power supply. With the technical solution adopted, the power socket is arranged at the lower end of the interior of the lamp body, the power supply is arranged on the power socket, and the first illuminating lamps and the water pump are electrically connected to the power supply.

The invention is further arranged to be that the second illuminating lamps electrically connected to the power supply are arranged at the upper end of the power socket, and a switch for switching on or switching off the first illuminating lamps, and the second illuminating lamps and the water pump is arranged on the power socket.

With the technical solution adopted, the second illuminating lamps are arranged on the power socket, so that the condition of dark caused by that a light source is not arranged at the lower end of the lamp body is avoided.

The invention is further arranged to be that the candle lamp also comprises a power supply adapter for supplying power for the first illuminating lamps and the water pump. With the technical solution adopted, when the power supply in the power socket is free from electricity, the power supply adapter is connected to an electric power system so as to supply power for the first illuminating lamps and the water pump in the candle lamp.

The invention is further arranged to be that the candle lamp also comprises a movable end for outputting a control signal, and a control end which is in wireless communication connection with the movable end and controls the switching on and the switching off of the first illuminating lamps or the switching on and the switching off of the water pump in response to the control signal, wherein the control end is electrically connected to the power supply, and the water pump and the first illuminating lamps are electrically connected to the control end.

With the technical solution adopted, when the switching on and the switching off of the first illuminating lamps and the water pump are regulated, the control signal is output by regulating the movable end, then the control end controls the switching on and the switching off of the first illuminating lamp and the water pump after receiving the control signal, and can control the switching on and the switching off of the bulb and the water pump at the distant place, which make the regulation convenient.

The invention is further arranged to be that the movable end is a remote control, and the control end is a control chip.

With the technical solution adopted, the movable end is the remote control, and the control end is the control chip.

The invention is further arranged to be that the control end can control the glimpsing of the first illuminating lamps.

With the technical solution adopted, the control end controls the glimpsing of the first illuminating lamps, so that the candle lamp is gorgeous in lighting effects and the visual art of the candle lamp is improved.

The invention is further arranged to be that the control end can control the color change of the first illuminating lamps.

With the technical solution adopted, the control end control the color change of the first illuminating lamps, so that the visual art of the candle lamp is improved.

The invention is further arranged to be that the control end comprises a delaying module for controlling the timed switching off of the first illuminating lamps and the water pump after receiving the control signal.

With the technical solution adopted, the control end can also control the timed switching off of the first illuminating lamps and the water pump.

In general, the candle lamp disclosed by the invention has the following beneficial effects that by arranging the water storage tank on the lamp body of the candle lamp, when the water pump in the water storage tank draw water out by the water chamber, the water is sprayed out from the water spray pipe to form a fountain, and the light of the first illuminating lamps illuminates a water column sprayed by the water spray pipe to achieve visual effect similar to rolling blaze, so that the visual art of the candle lamp is improved.

Figure 1:
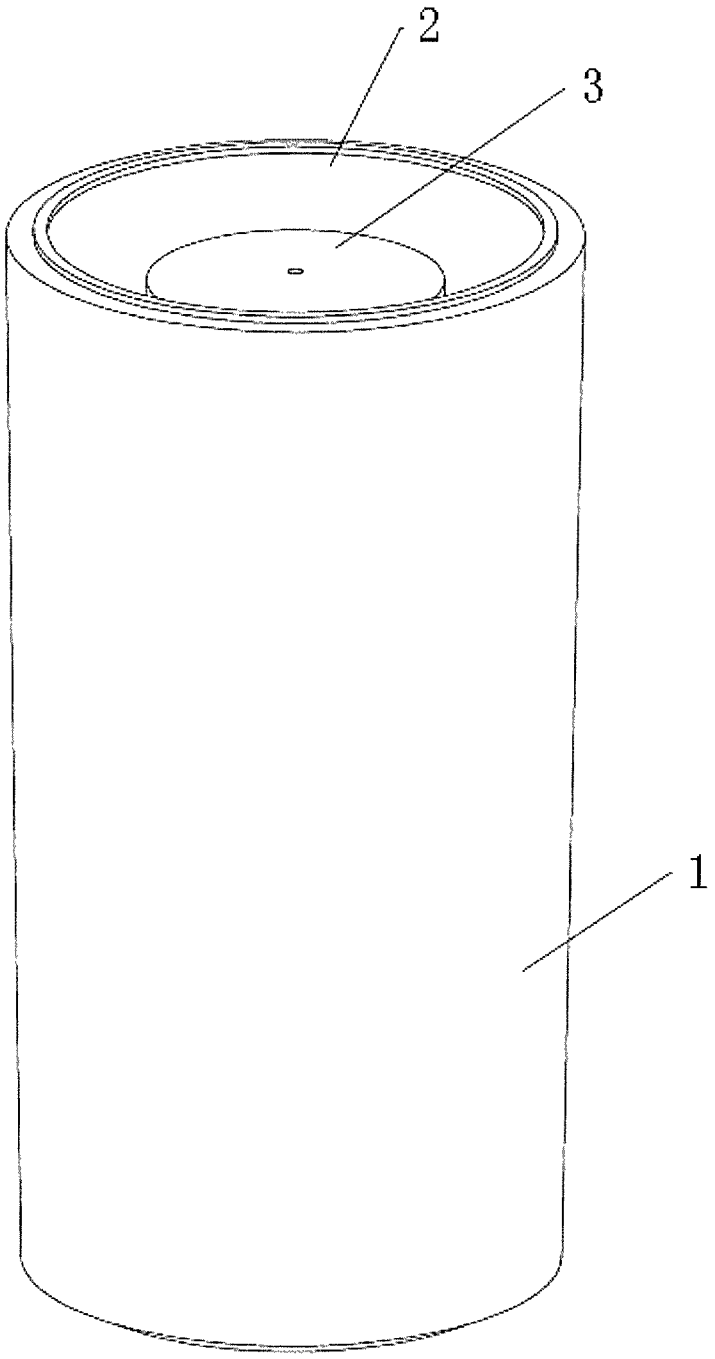
FIG. 1 is a schematic structural diagram of embodiment 1.

In the drawings: 1, lamp body; 11, step; 2, water storage tank; 21, groove; 22, water chamber; 221, water pump; 222, suction cup; 23, isolation plate; 231, water spray pipe; 232, backwater hole; 233, the first illuminating lamp; 24, decoration layer; 25, flange; 3, spray booth; 31, housing; 311, chamber; 32, paraffine layer; 33, connecting hole; 34, water spray hole; 35, air vent; 36, mounting hole; 37, water-penetrable hole; 38, spray pipe; 4, power socket; 41, power supply; 42, the second illuminating lamp; 43, switch; 5, control end; 6, movable end; 7, power supply adapter.

DETAILED DESCRIPTION OF THE INVENTION

Embodiment 1

Figure 2:
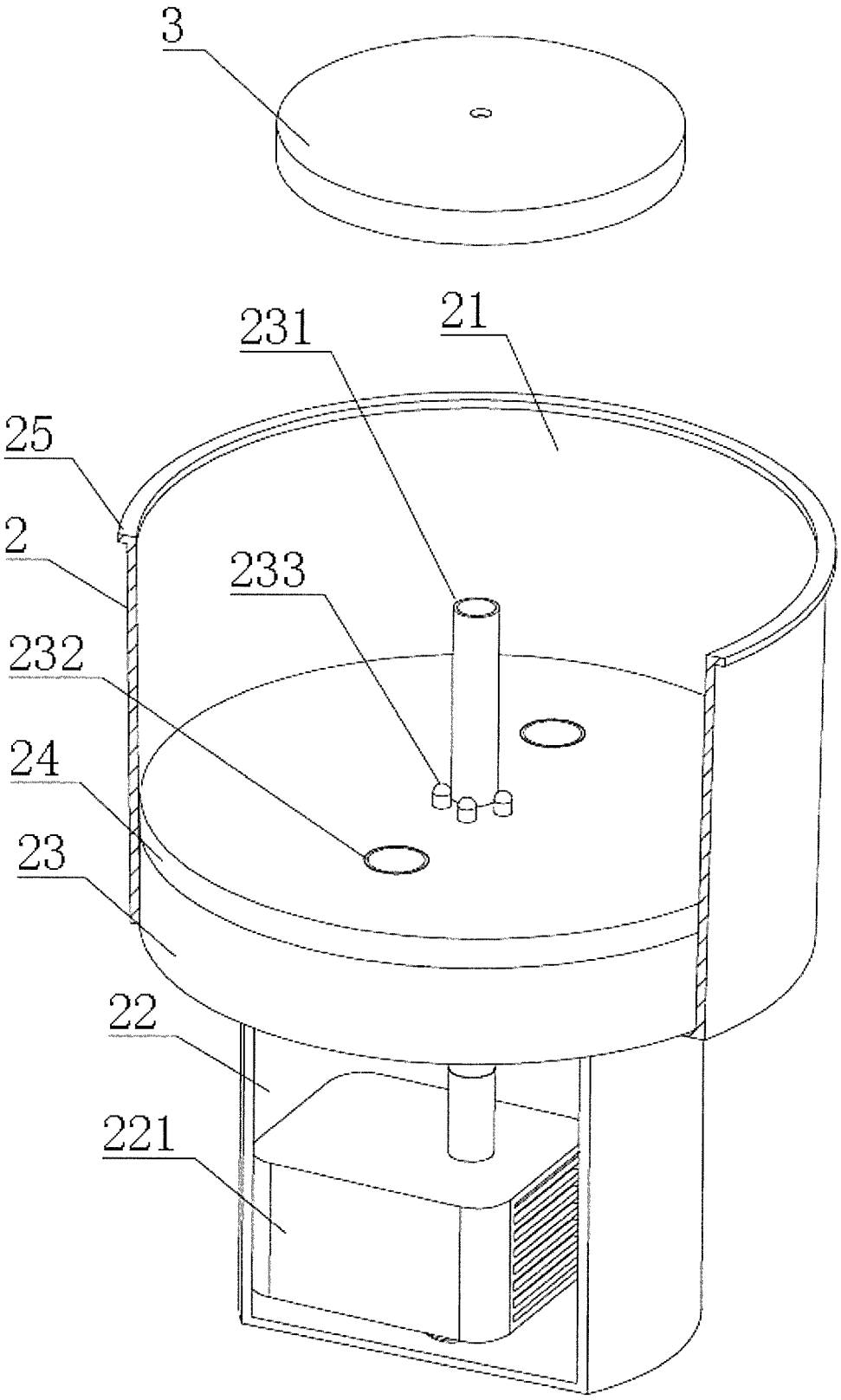
FIG. 2 is a schematic diagram of the position relationship of the water storage tank, the isolation plate, the water pump, and the water spray pipe in the embodiment 1.
Figure 6:
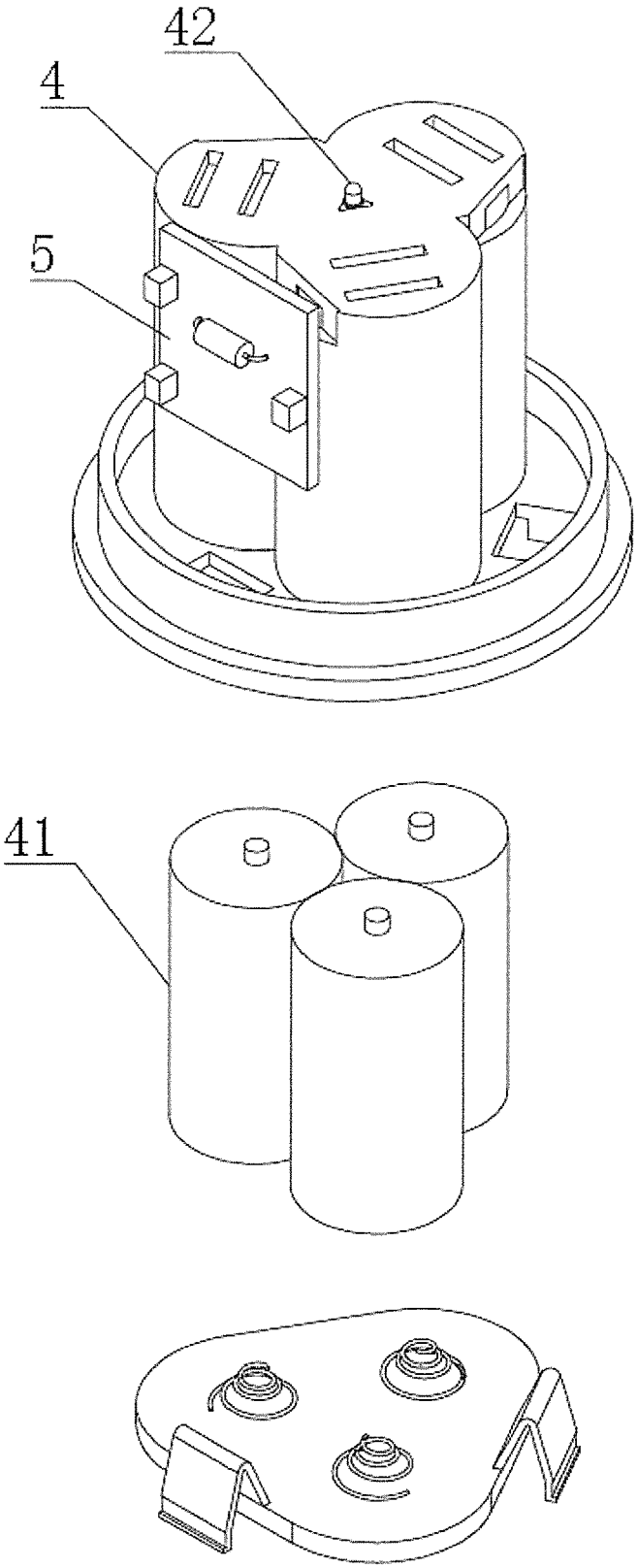
FIG. 6 is the schematic structural diagram of the power socket in the embodiment 1.

A candle lamp as shown in FIG. 1 and FIG. 2 comprises a hollow tubular lamp body 1, a water storage tank 2 arranged in the interior of the upper end of the lamp body 1, and a power socket 4 arranged in the interior of the lower end of the lamp body 1 (with reference to FIG. 6). The lamp body 1 is made of paraffine and is subtransparent. A power supply 41 (with reference to FIG. 6) is arranged on the power socket 4 (with reference to FIG. 6). The water storage tank 2 is made of a transparent plastic, an isolation plate 23 is arranged in the water storage tank 2, and the water storage tank 2 is divided into a water chamber 22 located at the lower part and a groove 21 formed in the upper part by the isolation plate 23. A transparent water spray pipe 231 is arranged on the isolation plate 23, the upper end of the water spray pipe 231 is located in the groove 21, and the lower end of the water spray pipe 231 is communicated with the water chamber 22. A backwater hole 232 passing through the isolation plate 23 is also formed in the isolation plate 23, and the groove 21 is communicated with the water chamber 22 by the backwater hole 232. A water pump 221 is arranged in the water chamber 22, and is connected with a power supply 41 by a wire. A water inlet of the water pump 221 is located in the water chamber 22, and a water outlet of the water pump 221 is communicated with the lower end of the water spray pipe 231. There are four the first illuminating lamps 233 that are arranged on the isolation plate 23 which are uniformly distributed in the circumferential direction of the water spray pipe 231 and electrically connected to a power supply 41.

When the candle lamp is used, water is injected to the water chamber 22, then the water pump 221 operates, and the water in the water chamber 22 enters the water inlet of the water pump 221, and is drained into the water spray pipe 231 from the water outlet of the water pump 221, and then is sprayed out from the upper end of the water spray pipe 231, and then falls down under the action of gravity after being sprayed from the water spray pipe 231, and then is collected to a groove 21 and then flows back to the water chamber 22 from the backwater hole 232 in the isolation plate 23. The first illuminating lamps 233 on the isolation plate 23 are connected to the power supply 41, and the light emitted by the first illuminating lamps 233 illuminates a water column sprayed from the water spray pipe 231 so as to achieve visual effect being similar to the glimmering flame. Besides, the water column sprayed from the water spray pipe 231 forms a fountain-like, so that the visual art of the candle lamp is improved.

Figure 3:
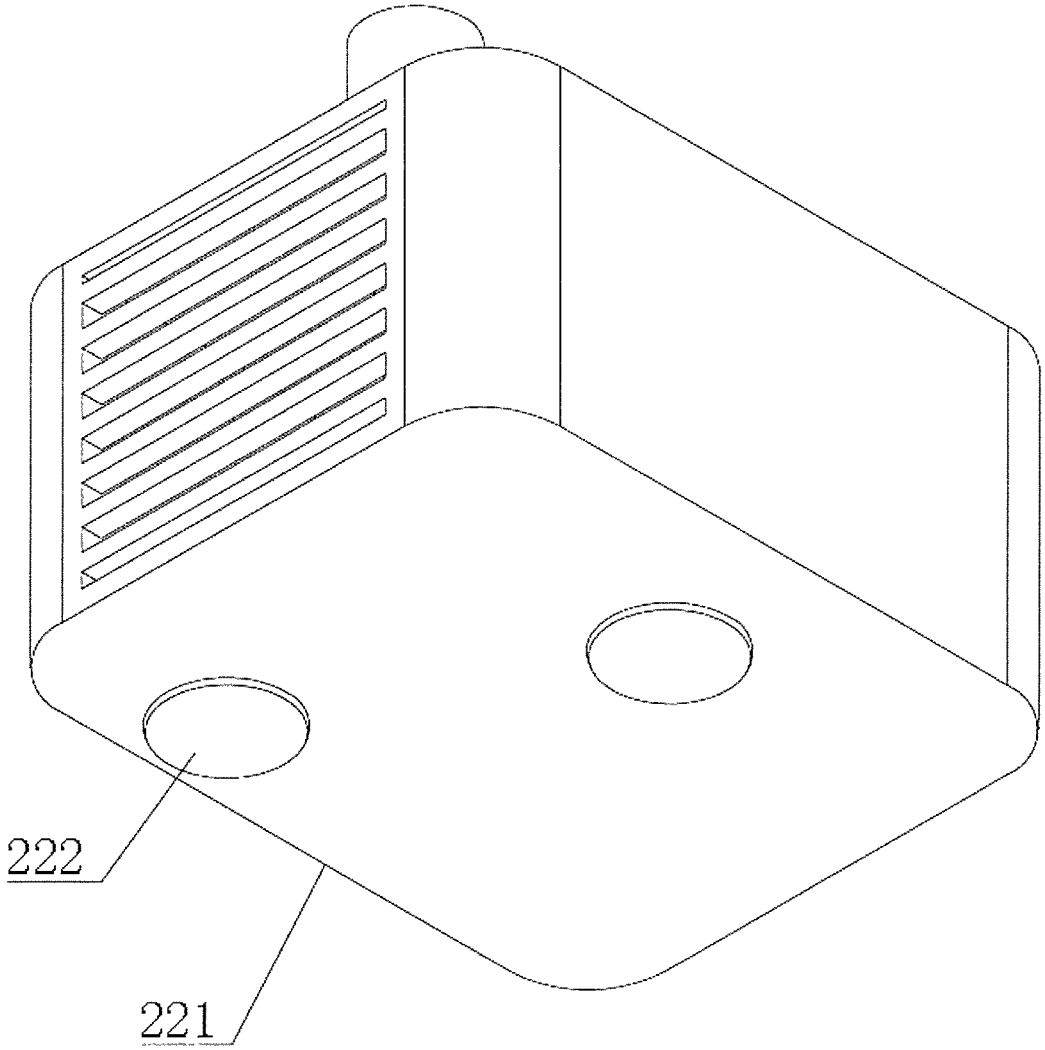
FIG. 3 is the schematic diagram of the position relationship of the water pump and the suction cups in the embodiment 1.
Figure 4:
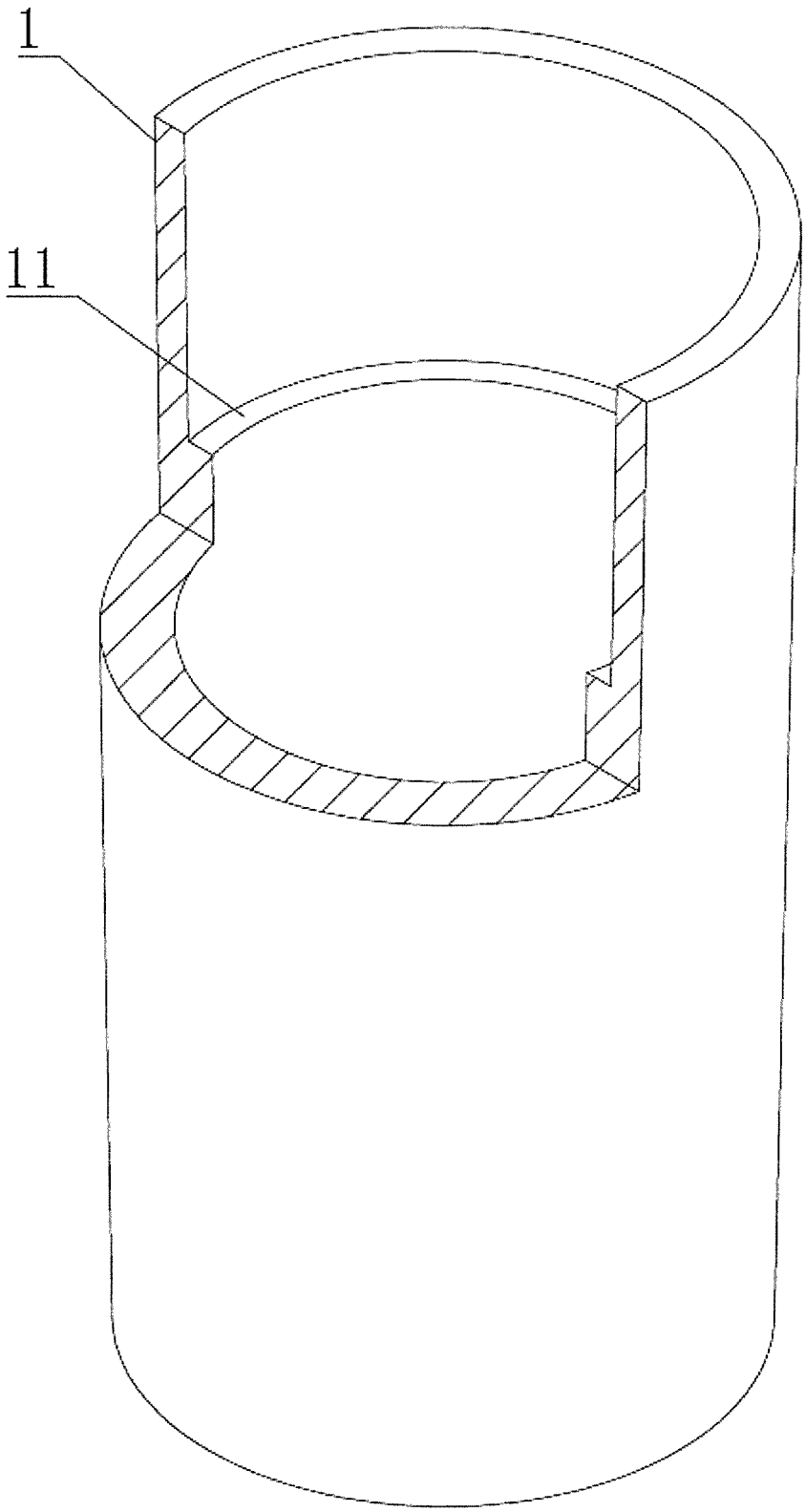
FIG. 4 is the schematic structural diagram of the step of the lamp body in the embodiment 1.

As shown in FIG. 2 and FIG. 4, a step 11 is arranged on the inner wall of the lamp body 1, and the water storage tank 2 is arranged on the step 11 in the lamp body 1. One circle of flange 25 is integrally arranged at the upper end of the water storage tank 2, and the lower end surface of the flange 25 is propped against the upper end surface of the lamp body 1. A decoration layer 24 is arranged on the upper end surface of the isolation plate 23 in the water storage tank 2, and is made of paraffine. As shown in FIG. 2 and FIG. 3, a plurality of suction cups 222 are arranged on the water pump 221 in the water chamber 22 and are drew to the inner wall of the water chamber 22 so that the water pump 221 is fixed in the water chamber 22.

Figure 5:
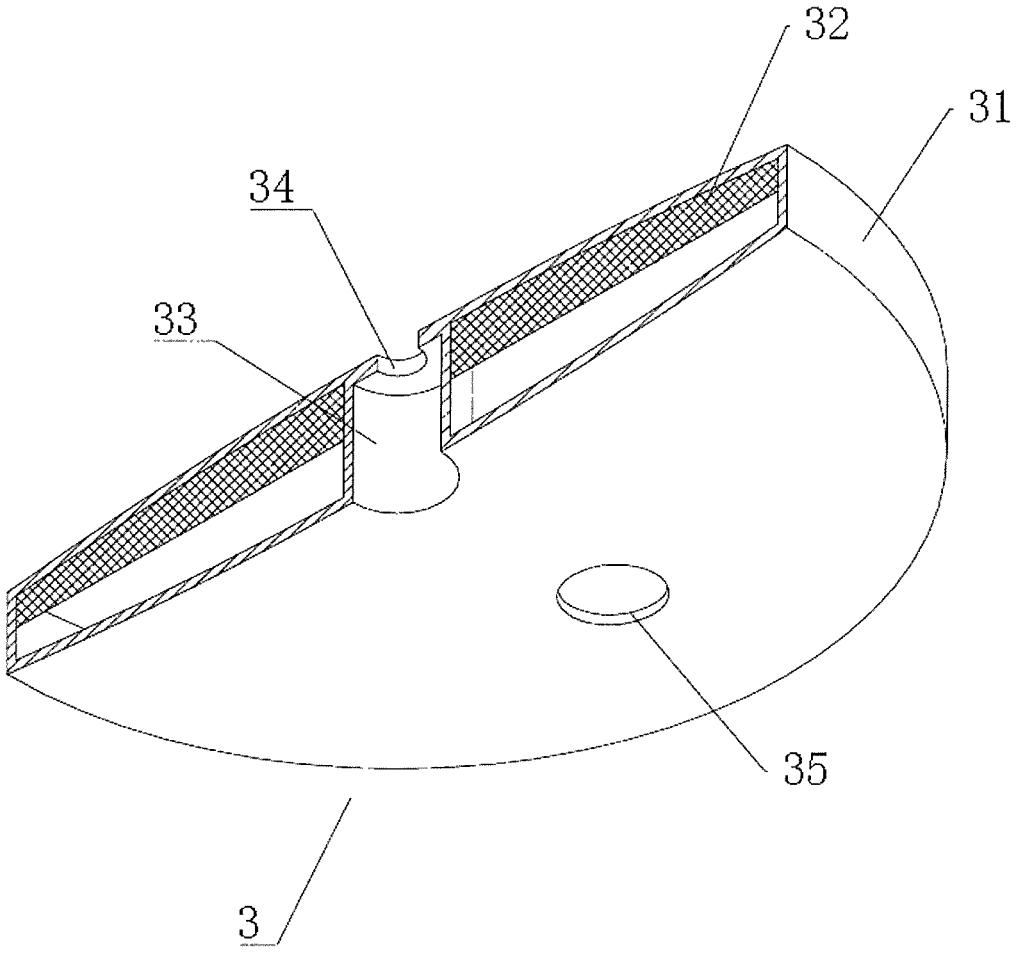
FIG. 5 is the schematic structural diagram of the spray booth in the embodiment 1.

As shown in FIG. 2 and FIG. 5, a spray booth 3 which is in the shape of the disk is arranged on the water spray pipe 231 and comprises a transparent hollow housing 31 and a paraffine layer 32 stuffed in the housing 31. The spray booth 3 is entirely subtransparent and is located above the first illuminating lamps 233, and the light emitted by the first illuminating lamps 233 is weakened after passing through the spray booth 3 and becomes soft. An air vent 35 is formed in the bottom of the housing 31, and is communicated with the interior of the housing 31. A connecting hole 33 is formed in the middle of the lower end surface of the spray booth 3, and the water spray pipe 231 is in inserting connection to the interior of the connecting hole 33, and a water spray hole 34 passing through the spray booth 3 is formed in the connecting hole 33. When the water spray pipe 231 sprays water, the water is sprayed out backwards and upwards from the water spray hole 34 in the spray booth 3. The upper end surface of the spray booth 3 is higher than the upper end of the water spray pipe 231, and when the water is sprayed out from the water spray pipe 231 and the water spray hole 34, the falling water forms a water layer on the surface of the spray booth 3, so that the water sprayed from the water spray pipe 231 moves upwards in the water layer so as to form a water column.

Figure 7:
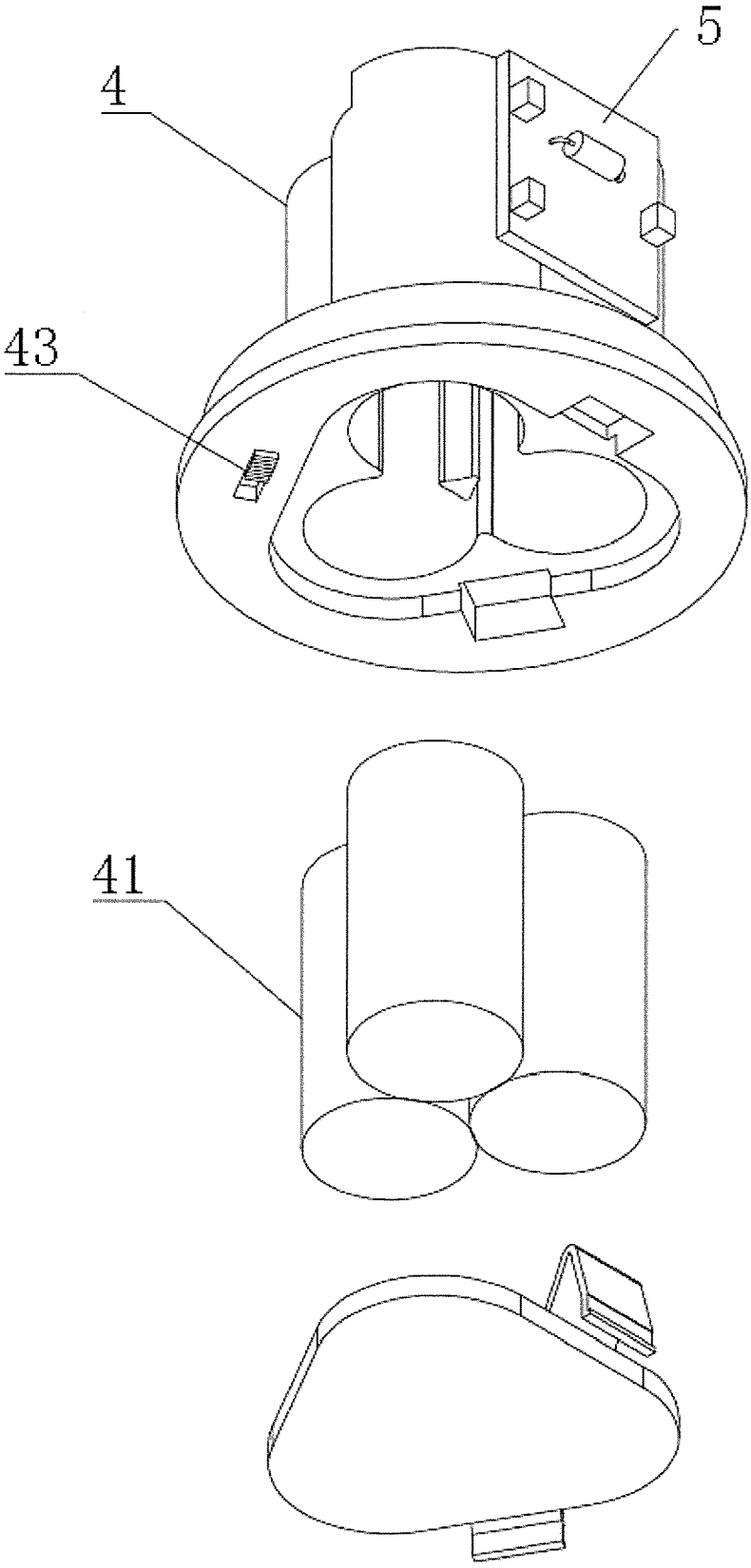
FIG. 7 is the schematic diagram of the position relationship of the power socket and the switch in the embodiment 1.

As shown in FIG. 6 and FIG. 7, the second illuminating lamps 42 are arranged on the power socket 4 at the lower end of the lamp body (1) (with reference to FIG. 1) and are located under the first illuminating lamps 233, and the first illuminating lamps 233 and the second illuminating lamps 42 are LED lamps. The second illuminating lamps 42 are electrically connected to the power supply 41. A switch 43 is arranged on the power socket 4, and when the switch 43 is switched on, the first illuminating lamps 233, the second illuminating lamps 42 and the water pump 221 are in the power-on state; When the switch 43 is switched off, the first illuminating lamps 233, the second illuminating lamps 42 and the water pump 221 are in the power-off state.

The work process of the candle lamp is as follows. Before the candle lamp is used, the water is injected to the water chamber 22, and the switch 43 is switched on, then the first illuminating lamps 233, the second illuminating lamps 42 and the water pump 221 are in the power-on state, and then the first illuminating lamps 233 and the second illuminating lamps 42 emit light, and the water pump 221 operates, then the water in the water chamber 22 enters from a water inlet of the water pump 221 and is drained from a water outlet of the water pump 221 into the water spray pipe 231, and then is sprayed out from the interior of the water spray pipe 231 so as to form the fountain. The light of the first illuminating lamps 233 illuminates the fountain so as to achieve visual effect being similar to the glimmering flame. Water sprayed from the water spray pipe 231 falls down to the groove 21, and then returns to the water chamber 22 through the backwater hole 232. The second illuminating lamps 42 are located under the first illuminating lamps 233, so that the case where darkness due to lack of a light source at the lower end of the lamp body 1 is avoided.

Embodiment 2

Figure 8:
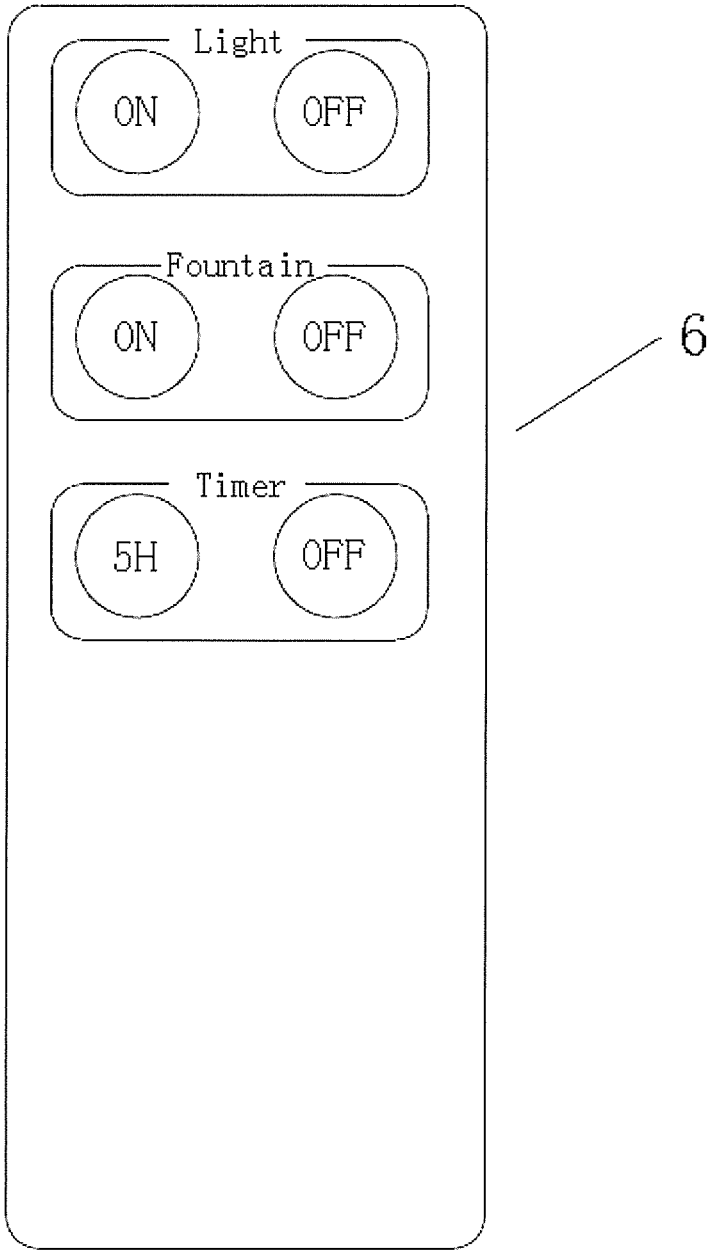
FIG. 8 is the schematic diagram of the movable end in the embodiment 2.

A candle lamp comprises the components shown in the Embodiment 1. As shown in FIG. 2. FIG. 6 and FIG. 8, the candle lamp also comprises a movable end 6 and a control end 5, wherein the movable end 6 is a remote control, the control end 5 is a control chip fixed to the power socket 4, and the control chip can be a single-chip microcomputer. The control chip is connected to a power supply 41 by a wire, and the first illuminating lamps 233, second illuminating lamps 42 and a water pump 221 are connected to the control chip by a wire. The movable end 6 and the control end 5 are in wireless communication connection, and the movable end 6 sends out a control signal, and the control end 5 controls the switching on and the switching off of the first illuminating lamps 233, the switching on and the switching off of the second illuminating lamps 42 and the switching on and the switching off of the water pump 221 after receiving a control signal. A delaying module is arranged in the control end 5, and after the movable end 6 sends out the control signal, the control end 5 receives the control signal, then the control end 5 can switch off the first illuminating lamps 233, the second illuminating lamps 42 and the water pump 221 in a timing manner. The control end 5 controls the first illuminating lamps 233 and the second illuminating lamps 42 glimmering continuously, and the control end 5 can also control the color change of the first illuminating lamps 233, so that the visual art of the candle lamp is improved.

Figure 9:
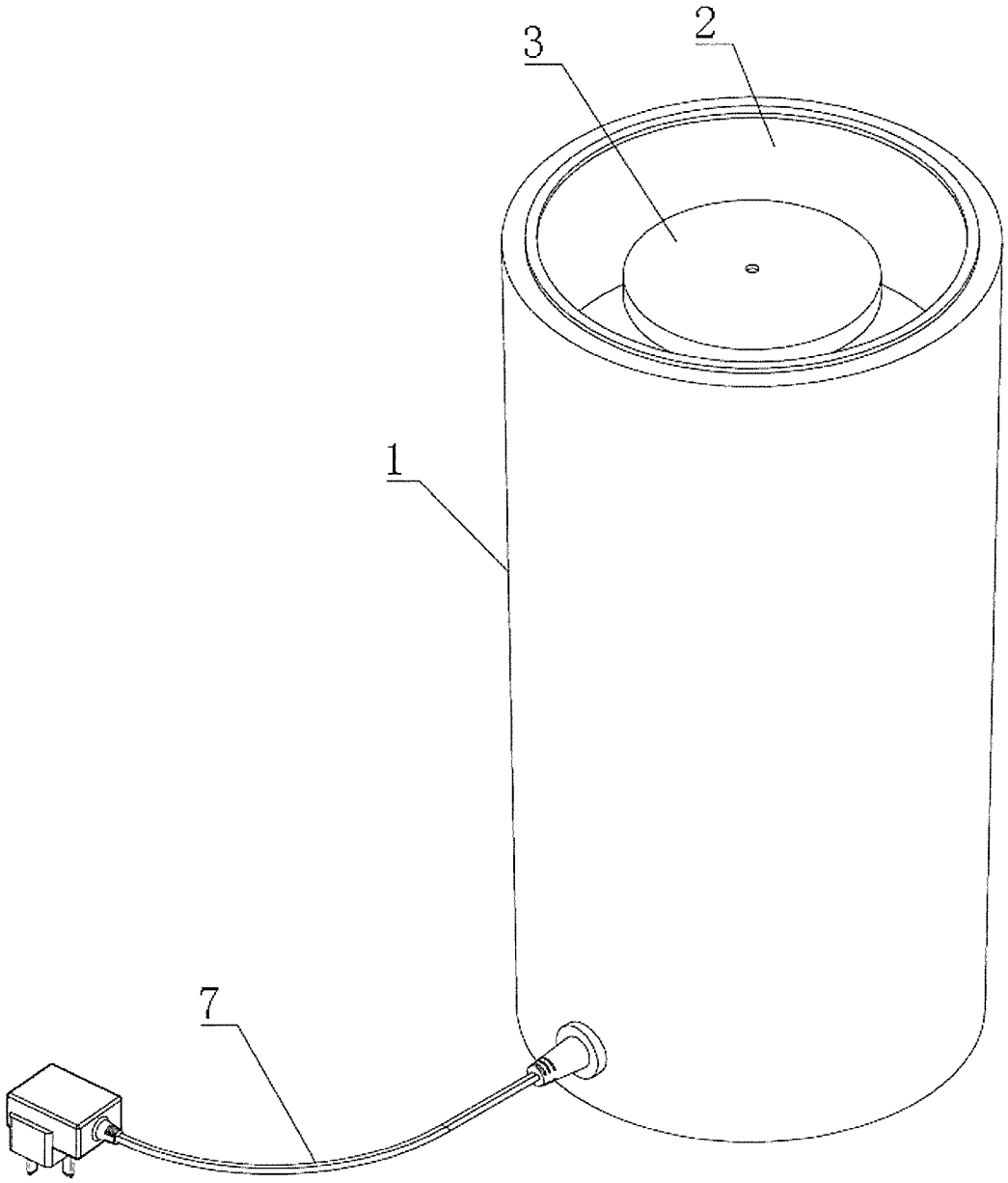
FIG. 9 is the schematic diagram of the position relationship of the power supply adapter and the lamp body in the embodiment 2.

As shown in FIG. 9, the candle lamp also comprises a power supply adapter 7. An interface is arranged on the lamp body 1, and a plug for being inserting connection to the interior of the interface is arranged on the power supply adapter 7, and the control end 5 is electrically connected to the interface by a wire. When the power supply 41 in the power socket 4 is free from electricity, the power supply adapter 7 is connected to an electric power system, and the plug of the power supply adapter 7 is in inserting connection to the interface on the lamp body 1, so that electricity is provided for the control end 5, the first illuminating lamps 233, the second illuminating lamps 42 and the water pump 221.

When the first illuminating lamps 233, the second illuminating lamps 42 and the water pump 221 on the lamp body 1 need to be controlled, the movable end 6 can be regulated at the distant place to give out the a control signal, and the control end 5 controls the switching on and the switching off of first illuminating lamps 233, the second illuminating lamps 42 and the water pump 221 after receiving the control signal, which make the regulation convenient.

Embodiment 3

Figure 10:
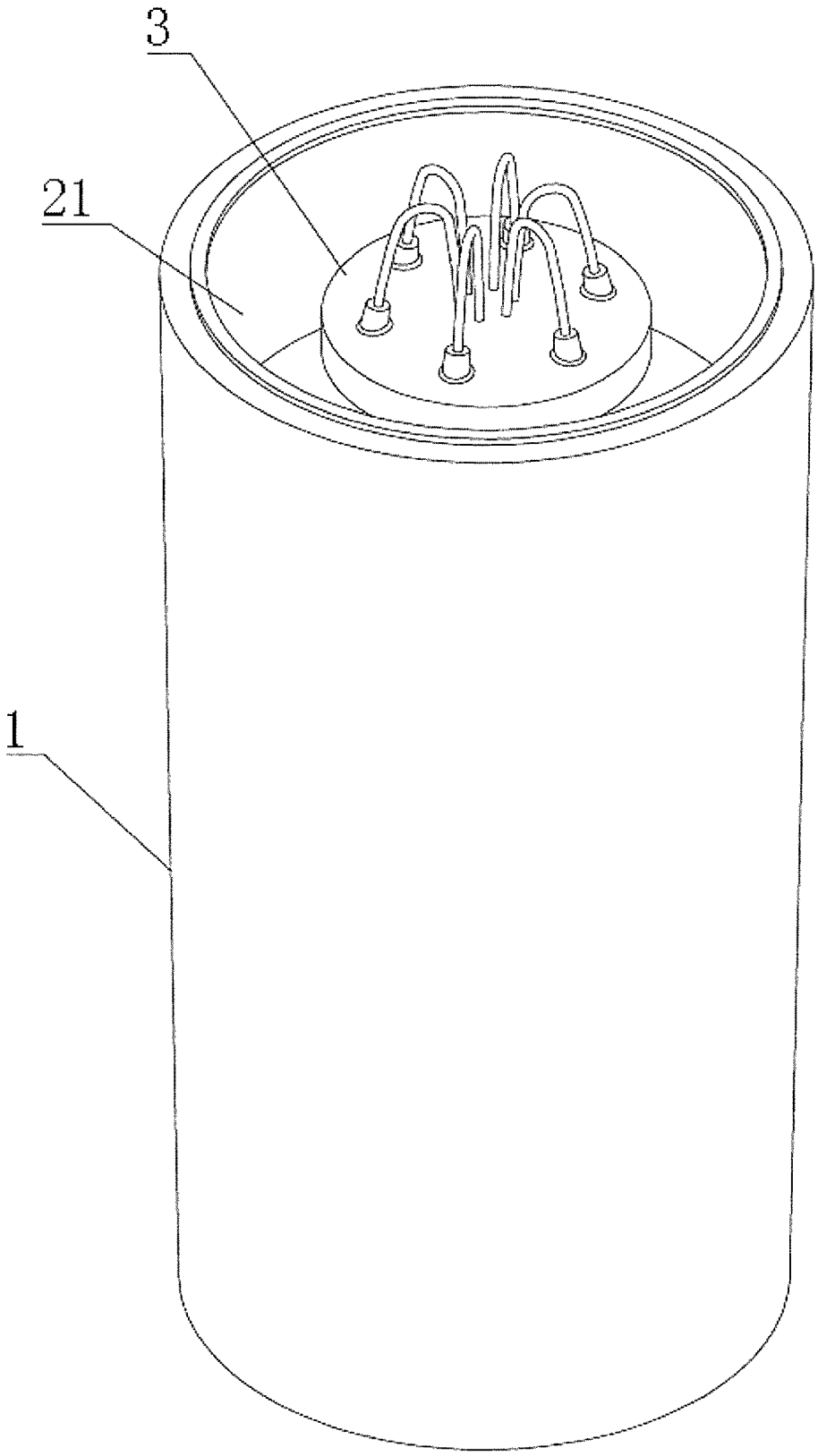
FIG. 10 is the schematic diagram of the position relationship of the lamp body and the spray booth in the embodiment 3.
Figure 11:
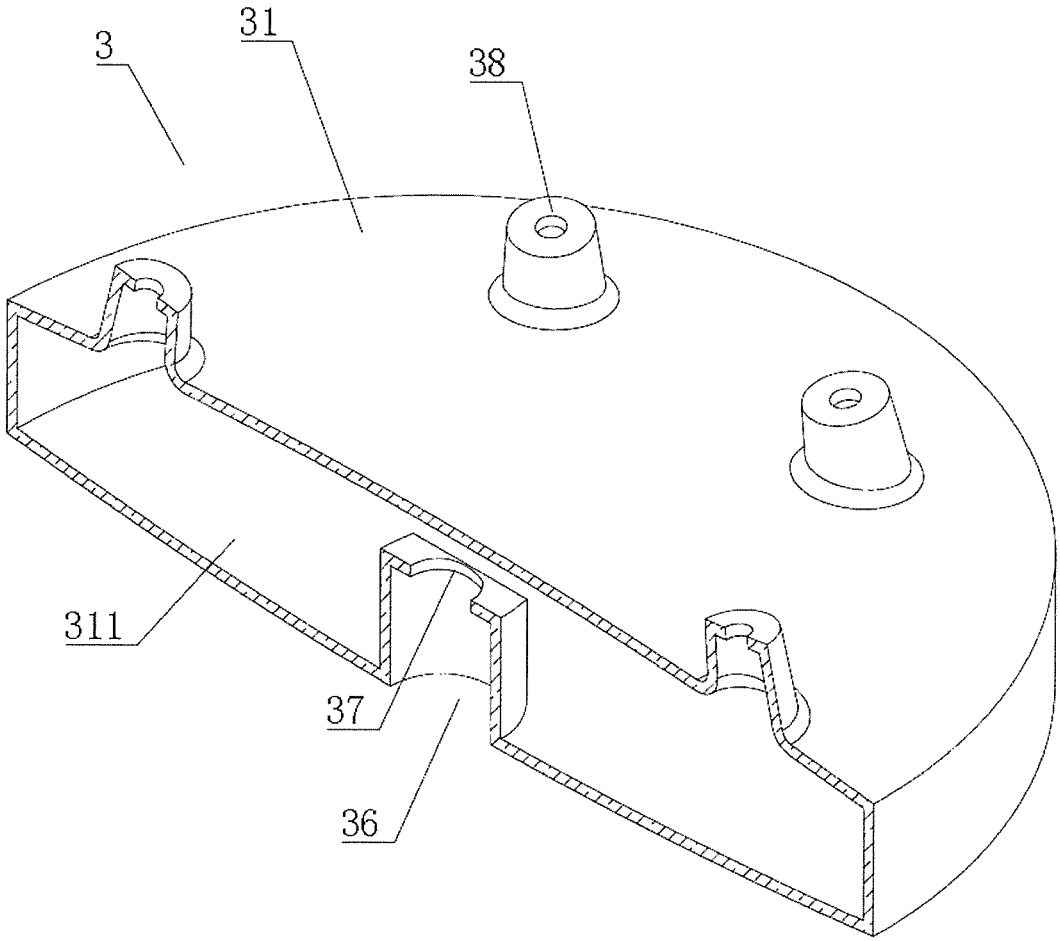
FIG. 11 is the schematic diagram of the internal structure of the spray booth in the embodiment 3.

A candle lamp different from Embodiment 1 lies in that as shown in FIG. 10 and FIG. 11, a spray booth 3 comprises a transparent hollow housing 31, wherein a chamber 311 is arranged in the housing 31. The middle of the lower end surface of the housing 31 is recessed to foam a mounting hole 36, and the upper end of a water spray pipe 231 is inserted into the mounting hole 36. A water-penetrable hole 37 communicated with the chamber 311 is formed in the inner wall of the mounting hole 36, and mouth on the upper end of the water spray pipe 231 is communicated with the chamber 311 of the housing 31 through the water-penetrable hole 37. 6 spray pipes 38 are arranged on the upper end surface of a spray booth 3, and are uniformly distributed in the circumferential direction of the spray booth 3. The lower end of the spray pipes 38 are communicated with the interior of the chamber 311, and the upper end face the upper end of the center of the spray booth 3.

When the candle lamp is used, a power supply 41 supplies power for the first illuminating lamps 233, the second illuminating lamps 42 and the water pump 221; water in the water chamber 22 enters a water pump 221, and enters the water spray pipe 231 from a water outlet of the water pump 221, then the water in the water spray pipe 231 enters the interior of the chamber 311 of the housing 31 through a water-penetrable hole 37, and is sprayed out from the spray pipes 38 at the upper end of the housing 31; and, the light emitted by the first illuminating lamps 233 at the lower end of the housing 31 illuminates a water column sprayed by the spray pipes 38 to imitate the visual effect of rolling blaze in the burning process of a candle, and the visual art of the candle lamp is improved.

Embodiment 4 a candle lamp different from Embodiment 1 lies in that there are 2 the first illuminating lamps 233 that are arranged on an isolation plate 23 and are uniformly distributed in the circumferential direction of a water spray pipe 231.

The invention claimed is:

1. A candle lamp, characterized in that, comprises a hollow tubular lamp body (1), a water storage tank (2) arranged in the lamp body (1) and an isolation plate (23) arranged in the water storage tank (2), wherein the water storage tank (2) is divided into a water chamber (22) located at the lower part and a groove (21) located at the upper part through the isolation plate (23); the isolation plate (23) is arranged thereon with a water spray pipe (231) for communicating the water chamber (22) with the groove (21), a plurality of first illuminating lamps (233) distributed around the water spray pipe (231), and a backwater hole (232) extending through the isolation plate (23) for communicating the groove (21) with the water chamber (22); a water pump (221) is arranged in the water chamber (22), and a water outlet of the water pump (221) is communicated with the water spray pipe (231), and a water inlet of the water pump (221) is formed in the water chamber (22); and, the lamp body (1) is subtransparent, wherein the water spray pipe (231) is arranged with a spray booth (3) located above the first illuminating lamps (233), wherein the spray booth (3) comprises a hollow transparent housing (31) and a chamber (311) is arranged in the housing (31), and a mounting hole (36) allowing the upper end of the water spray pipe (231) to be inserted is formed in the lower end surface of the housing (31), and a water-penetrable hole (37) communicating the water spray pipe (231) with the chamber (311) is formed in the mounting hole (36); and a plurality of spray pipes (38) communicated with the chamber (311) and used for spraying water to a position above the center of the spray booth (3) are arranged on the upper end surface of the spray booth (3).

2. The candle lamp of claim 1, characterized in that a connecting hole (33) is formed in the lower end surface of the spray booth (3), and the water spray pipe (231) is in inserting connection to the interior of the connecting hole (33), and a water spray hole (34) communicated with the water spray pipe (231) is formed in the upper end surface of the spray booth (3).

3. The candle lamp of claim 2, characterized in that the spray booth (3) comprises a paraffine layer (32) filled in the housing (31), wherein an air vent (35) communicated with the interior of the housing (31) is formed in the lower end surface of the housing (31).

4. The candle lamp of claim 1, characterized in that the spray booth (3) is in the shape of a disk, and the spray pipes (38) are uniformly distributed in the circumferential direction of the spray booth (3).

5. The candle lamp of claim 1, characterized in that a plurality of the first illuminating lamps (233) are uniformly distributed in the circumferential direction of the water spray pipe (231), wherein the number of the first illuminating lamps (233) is 2 or 4.

6. The candle lamp of claim 1, characterized in that a decoration layer (24) is arranged on the upper end surface of the isolation plate (23), and is made of paraffine.

7. The candle lamp of claim 1, characterized in that a plurality of suction cups (222) are arranged on the water pump (221), and suction cups (222) are stuck to the inner wall of the water chamber (22).

8. The candle lamp of claim 1, characterized in that the material of water storage tank (2) is transparent, and a step (11) is arranged on the inner wall of the lamp body (1), and the water storage tank (2) is placed on the step (11).

9. The candle lamp of claim 8, characterized in that one circle of flange (25) is arranged on the upper end of the water storage tank (2), and lower end surface of the flange (25) is propped against the upper end surface of the lamp body (1).

10. The candle lamp of claim 1, characterized in that the material of lamp body (1) is paraffine.

11. The candle lamp of claim 1, characterized in that a power socket (4) is arranged in the lower end of the lamp body (1), and a power supply (41) is mounted in the power socket (4), and the first illuminating lamps (233) and the water pump (221) are electrically connected to the power supply (41).

12. The candle lamp of claim 11, characterized in that the second illuminating lamps (42) electrically connected to the power supply (41) are arranged at the upper end of the power socket (4), and a switch (43) for switching on and switching off the first illuminating lamps (233), a second illuminating lamps (42) and the water pump (221) is arranged on the power socket (4).

13. The candle lamp of claim 11, characterized in that the candle lamp also comprises a power supply adapter (7) for supplying power to the first illuminating lamps (233) and the water pump (221).

14. The candle lamp of claim 1, characterized in that the candle lamp also comprises a movable end (6) for outputting a control signal, and a control end (5) which is in wireless communication connection with the movable end (6) and controls the switching on and the switching off of the first illuminating lamps (233) or the switching on and the switching off of the water pump (221) in response to the control signal, wherein the control end (5) is electrically connected to the power supply (41), and the water pump (221) and the first illuminating lamps 1 (233) are electrically connected to the control end (5).

15. The candle lamp of claim 14, characterized in that the movable end (6) is a remote control and the control end (5) is a control chip.

16. The candle lamp of claim 14, characterized in that the control end (5) can control the glimmering of the first illuminating lamps (233).

17. The candle lamp of claim 14, characterized in that the control end (5) can control the color change of the first illuminating lamps (233).

18. The candle lamp of claim 14, characterized in that the control end (5) comprises a delaying module for receiving the control signal to control the timed switching off of the first illuminating lamps (233) and the water pump (221).

* * * * *